US012752324B2

(12) United States Patent
Lan et al.

(10) Patent No.: US 12,752,324 B2
(45) Date of Patent: Oct. 6, 2026

(54) MANUFACTURING METHOD FOR TINPLATE

(71) Applicants: ZHANGJIAGANG YANGTZE RIVER COLD ROLLED PLATE CO., LTD., Suzhou (CN); INSTITUTE OF RESEARCH OF IRON AND STEEL, JIANGSU PROVINCE/SHA-STEEL, CO. LTD (CN), Suzhou (CN); JIANGSU SHAGANG GROUP CO., LTD., Suzhou (CN)

(72) Inventors: Haotian Lan, Suzhou (CN); Yifeng Song, Suzhou (CN); Xiaohan Xu, Suzhou (CN); Chongxiang Yue, Suzhou (CN)

(73) Assignees: ZHANGJIAGANG YANGTZE RIVER COLD ROLLED PLATE CO., LTD., Suzhou (CN); INSTITUTE OF RESEARCH OF IRON AND STEEL, JIANGSU PROVINCE/SHA-STEEL, CO. LTD (CN), Suzhou (CN); JIANGSU SHAGANG GROUP CO., LTD., Suzhou (CN)

( * ) Notice: Subject to any disclaimer, the term of this patent is extended or adjusted under 35 U.S.C. 154(b) by 75 days.

(21) Appl. No.: 19/018,724

(22) Filed: Jan. 13, 2025

(65) Prior Publication Data

US 2025/0144686 A1 May 8, 2025

Related U.S. Application Data

(63) Continuation of application No. PCT/CN2023/109553, filed on Jul. 27, 2023.

(30) Foreign Application Priority Data

Dec. 20, 2022 (CN) ..... 202211636408.9

(51) Int. Cl.

| | |
|---|---|
| ***B21B 3/02*** | (2006.01) |
| ***B21B 27/00*** | (2006.01) |
| ***B21B 37/58*** | (2006.01) |
| ***C23C 22/24*** | (2006.01) |
| ***C23C 22/78*** | (2006.01) |
| ***C25D 3/32*** | (2006.01) |
| ***C25D 5/36*** | (2006.01) |
| ***C25D 7/06*** | (2006.01) |
| ***C25D 17/02*** | (2006.01) |

(52) U.S. Cl.

CPC ..... *B21B 3/02* (2013.01); *B21B 27/005* (2013.01); *B21B 37/58* (2013.01); *C23C 22/24* (2013.01); *C23C 22/78* (2013.01); *C25D 3/32* (2013.01); *C25D 5/36* (2013.01); *C25D 7/0614* (2013.01); *C25D 17/02* (2013.01); *B21B 2261/14* (2013.01); *B21B 2267/10* (2013.01)

(58) Field of Classification Search

None

See application file for complete search history.

(56) References Cited

U.S. PATENT DOCUMENTS

| | | | | |
|---|---|---|---|---|
| 3,372,578 | A * | 3/1968 | Harmon | G01B 7/34 73/105 |
| 5,296,128 | A | 3/1994 | Gernon et al. | |
| 6,261,702 | B1 * | 7/2001 | McGuire | B21B 1/227 428/600 |
| 2020/0406322 | A1 * | 12/2020 | Baart | B21B 1/227 |
| 2023/0323495 | A1 * | 10/2023 | Hensen | C21D 8/0226 428/659 |

FOREIGN PATENT DOCUMENTS

| | | | |
|---|---|---|---|
| CN | 102162110 | A | 8/2011 |
| CN | 104711474 | A | 6/2015 |
| CN | 106544588 | A | 3/2017 |
| CN | 104711474 | B * | 4/2017 |
| CN | 105917039 | A | 7/2017 |
| CN | 107904638 | A | 4/2018 |
| CN | 113560436 | A | 10/2021 |
| CN | 114086222 | A | 2/2022 |
| CN | 114507813 | A | 5/2022 |
| CN | 115627502 | A | 1/2023 |
| JP | S5816095 | A | 1/1983 |
| JP | 2006328446 | A | 12/2006 |
| JP | 2010209435 | A | 9/2010 |
| WO | 2010090267 | A1 | 8/2010 |

OTHER PUBLICATIONS

First Office Action dated Feb. 1, 2023 for CN patent application No. 2022116364089.

(Continued)

*Primary Examiner* — Seth Dumbris

(74) *Attorney, Agent, or Firm* — DINSMORE & SHOHL LLP

(57) ABSTRACT

Disclosed is a manufacturing method for a tinplate, relating to the technical field of steel plate manufacturing. With regard to the manufacturing method for a tinplate: in the step of flattening a base plate, double stands are used for flattening, a first stand working roller have a surface roughness value Ra of 1.6-1.7 μm and a rolling force of 5000-6000 kN, and a second stand working roller have a surface roughness value Ra of 0.5-0.6 μm and a rolling force of 3000-4000 kN; in the step of electroplating the base plate, an electroplating solution have a $Sn^{2+}$ concentration of 14-19 g/L; and in the step of passivating the base plate, a passivation solution have a temperature of 41-43° C., a pH value of 4.4-4.6, and a concentration of 16-18 g/L, the passivation electric charge density being 120-180 $C/m^2$.

11 Claims, No Drawings

(56) References Cited

OTHER PUBLICATIONS

First Office Action dated Sep. 2, 2025 for JP patent application No. 2024-553695.
International Search Report for PCT/CN2023/109553, dated Oct. 13, 2023, 3 pages.

* cited by examiner

MANUFACTURING METHOD FOR TINPLATE

CROSS-REFERENCE TO RELATED APPLICATIONS

The present application is a bypass continuation application of International Application No. PCT/CN2023/109553, filed Jul. 27, 2023, which claims priority to Chinese Patent Application No. 202211636408.9, filed Dec. 20, 2022 and entitled "MANUFACTURING METHOD FOR TINPLATE", the disclosures of which are hereby incorporated by reference in their entirety.

TECHNICAL FIELD

The present application relates to the technical field of steel plate manufacturing, in particular to a method for manufacturing a tin-plated steel plate.

BACKGROUND

A tin-plated steel plate is an environmentally friendly and safe packaging material, which is widely applied to the production of can bodies, top covers, etc. of beverage cans, food cans, and aerosol cans. An existing method for producing a tin-plated steel plate includes following steps: performing alkali washing, continuous annealing, leveling, trimming, oiling, and coiling on a substrate, and then performing alkali washing, pickling, electroplating, fluxing, soft melting, passivating, oiling, and coiling on the substrate to obtain the tin-plated steel plate.

The cans made of the tin-plated steel plate often need to be painted on internal and external surfaces to provide protection and decorative effects, especially for the food cans and beverage cans, which have extremely high requirements for paint adhesion, usually at least needing to reach level 2. Patent CN107904638B discloses a method for producing a high-adhesion electroplated tin plate, improving adhesion of a tin-plated steel plate by controlling and optimizing a passivating process of the tin-plated steel plate, so that its adhesion is level 1. However, this method limits a mass content of $Cr(OH)_3$ in a passivation film organization structure to less than 40%, which ensures the adhesion, but with the lower mass content of $Cr(OH)_3$, a corrosion resistance of the obtained tin-plated steel plate is also poorer. During industrial batch production, some batches have a hidden danger of an unqualified corrosion resistance, which affects the normal use of the tin-plated steel plate.

SUMMARY

A technical problem to be solved by the present application is to overcome a defect in the prior art that it is difficult for a corrosion resistance and adhesion of a tin-plated steel plate to meet use requirements at the same time.

In order to solve the above technical problem, a technical solution adopted by the present application is as follows:

a. according to a method for manufacturing a tin-plated steel plate, in a step of leveling a substrate, double-stand leveling is adopted, and use distances of a first stand work roll and a second stand work roll are ≤600 km; a surface roughness value Ra of the first stand work roll is in a range from 1.6 μm to 1.7 μm, and a rolling force is in a range from 5000 kN to 6000 kN; a surface roughness value Ra of the second stand work roll is in a range from 0.5 μm to 0.6 μm, and a rolling force is in a range from 3000 kN to 4000 kN;

b. in a step of electroplating the substrate, an $Sn^{2+}$ concentration of an electroplating solution is in a range from 14 g/L to 19 g/L;

c. in a step of passivating the substrate, a temperature of a passivation solution is in a range from 41° C. to 43° C., a pH value is in a range from 4.4 to 4.6, a concentration is in a range from 16 g/L to 18 g/L, and a passivation power density is in a range from 120 $C/m^2$ to 180 $C/m^2$;

d. when a surface roughness value Ra and a crest number Rpc of the substrate meet 115≤100× Ra+Rpc<130, 120 $C/m^2$≤passivation power density <150 $C/m^2$; and e. when the surface roughness value Ra and the crest number Rpc of the substrate meet 130≤100×Ra+Rpc≤155, 150 $C/m^2$≤passivation power density ≤180 $C/m^2$.

The unit of the surface roughness value Ra is m, and the unit of the crest number Rpc of the substrate is $cm^{-1}$.

Further, a leveling elongation in the leveling step is in a range from 1% to 1.8%.

a. Further, in the leveling step:
   when the use distance of the first stand work roll is ≤50 km, 5000 kN≤the rolling force of the first stand work roll≤5100 kN;

b. when 50 km<the use distance of the first stand work roll≤100 km, 5100 kN<the rolling force of the first stand work roll≤5200 kN;

c. when 100 km<the use distance of the first stand work roll≤500 km, 5200 kN<the rolling force of the first stand work roll≤5700 kN; and d. when 500 km<the use distance of the first stand work roll≤600 km, 5700 kN<the rolling force of the first stand work roll≤6000 kN.

Further, in the leveling step:

a. when the use distance of the second stand work roll is ≤50 km, 3000 kN≤the rolling force of the second stand work roll≤3200 kN;

b. when 50 km<the use distance of the second stand work roll≤100 km, 3200 kN<the rolling force of the second stand work roll≤3400 kN;

c. when 100 km<the use distance of the second stand work roll≤500 km, 3400 kN<the rolling force of the second stand work roll≤3800 kN; and d. when 500 km<the use distance of the second stand work roll≤600 km, 3800 kN<the rolling force of the second stand work roll≤4000 kN.

Further, after the leveling step, the substrate has the surface roughness value Ra ranging from 0.5 μm to 0.6 μm and the crest number Rpc ranging from 65 $cm^{-1}$ to 95 $cm^{-1}$.

Further, an electroplating mode in the electroplating step is a methanesulfonic acid electroplating process, and the substrate passes through an electroplating tank at a speed ranging from 200 m/min to 300 m/min during electroplating.

Further, in the electroplating step, a temperature of the electroplating solution is in a range from 35° C. to 55° C.

Further, in the electroplating step, a concentration of a free acid in the electroplating solution is in a range from 28 mL/L to 38 mL/L.

And/or, a total current of an electroplating single face is in a range from 5.3 KA to 11.6 KA, and a current cathode efficiency is in a range from 80% to 90%.

Further, after the passivating step, a $Cr(OH)_3/Cr_2O_3$ passivation film is formed on a surface of the substrate; and a. a mass content ratio of $Cr(OH)_3$ to $Cr_2O_3$ in the passivation film is in a range from 1 to 1.5.

Further, a continuous annealing step is further included before leveling, and tensile strength of the substrate after the continuous annealing step is in a range from 385 MPa to 485 MPa.

Further, the passivation solution is a sodium dichromate solution.

The technical solution of the present application has following advantages.

a. In the method for manufacturing the tin-plated steel plate provided by the present application, the surface roughness values and the rolling forces of the stand work rolls in the leveling step are limited. The electroplating solution in the electroplating step is adjusted, and the passivation solution and the passivation power density in the passivating step are limited. Through a synergistic effect of various process parameters, adhesion of the tin-plated steel plate is improved, and a corrosion resistance of the tin-plated steel plate is ensured, so that the corrosion resistance and the adhesion thereof can meet use requirements at the same time.

b. In the method for manufacturing the tin-plated steel plate provided by the present application, the attenuation of surface roughness of the work rolls in an actual use process is fully taken into account. The attenuation of the surface roughness of the work rolls will have a direct effect on the surface roughness value of the leveled substrate. The present application combines the number of kilometers used by the work rolls to formulate a roll distribution solution and a rolling force distribution solution for leveling, giving the substrate the appropriate surface roughness value Ra and the crest number Rpc, so that the substrate has a suitable surface condition, which lays a good foundation for the production of the tin-plated steel plate with the high adhesion.

c. In an existing method for manufacturing a tin-plated steel plate, a passivation film mainly contains $Cr(OH)_3$ and $Cr_2O_3$, in addition to a very small amount of metal Cr and $Cr^{6+}$. The reduction of a mass content of $Cr(OH)_3$ in the passivation film can effectively improve adhesion, while a too low mass content of $Cr(OH)_3$ results in deterioration of the corrosion resistance of the tin-plated steel plate. The present application takes into account both the adhesion and the corrosion resistance of the tin-plated steel plate by means of specific process parameters for leveling, electroplating and passivating processes, so that both the corrosion resistance and adhesion thereof can meet the use requirements.

DETAILED DESCRIPTION

The following embodiments are provided for a better and further understanding of the present application, are not limited to the best implementation, and do not constitute a limitation on the contents and scope of protection of the present application, and any product identical or similar to the present application derived by any person under the inspiration of the present application or by combining the present application with features of other prior art falls within the scope of protection of the present application.

Embodiments where specific experimental steps or conditions are not indicated may be performed according to operations or conditions of conventional experimental steps described in the literature in the field. Reagents or instruments used without indicating manufacturers are all routine reagent products that are commercially available.

In a method for manufacturing a tin-plated steel plate provided in the present application, a roll distribution solution for a leveling step is coordinated, a rolling solution is formulated according to the number of kilometers used by work rolls, and electroplating and passivating processes are optimized, in addition to which preparation steps are all well-known techniques to personnel in the industry.

Components of a low-carbon cold-rolled hard steel plate used in each embodiment of the present application are shown in Table 1.

TABLE 1

Components of a low-carbon cold-rolled hard steel plate used in each embodiment

| Components | C(%) | Si(%) | Mn(%) | P(%) | S(%) | Al(%) | N(%) |
|---|---|---|---|---|---|---|---|
| Range | 0.055-0.085 | ≤0.03 | 0.15-0.45 | ≤0.015 | ≤0.01 | 0.025-0.055 | ≤0.0035 |
| Embodiment 1 | 0.07 | 0.008 | 0.21 | 0.0006 | 0.006 | 0.025 | 0.0029 |
| Embodiment 2 | 0.0718 | 0.015 | 0.26 | 0.008 | 0.009 | 0.028 | 0.0033 |
| Embodiment 3 | 0.0765 | 0.016 | 0.36 | 0.015 | 0.005 | 0.043 | 0.0028 |
| Embodiment 4 | 0.0833 | 0.03 | 0.3 | 0.014 | 0.01 | 0.035 | 0.0034 |
| Embodiment 5 | 0.0608 | 0.012 | 0.22 | 0.009 | 0.001 | 0.049 | 0.0029 |
| Embodiment 6 | 0.0787 | 0.02 | 0.42 | 0.012 | 0.003 | 0.047 | 0.0031 |
| Embodiment 7 | 0.055 | 0.011 | 0.15 | 0.001 | 0.002 | 0.045 | 0.0022 |
| Embodiment 8 | 0.085 | 0.009 | 0.45 | 0.005 | 0.002 | 0.055 | 0.0035 |
| Embodiment 9 | 0.062 | 0.007 | 0.22 | 0.011 | 0.008 | 0.031 | 0.0021 |

Embodiment 1

This embodiment provides a method for manufacturing a tin-plated steel plate, including following steps: alkali washing, continuous annealing, leveling, trimming, oiling, and coiling are performed on a substrate sequentially, and then alkali washing, pickling, electroplating, fluxing, soft melting, passivating, oiling, and coiling are performed on the substrate to obtain the tin-plated steel plate. Specifically:

a low-carbon cold-rolled hard steel plate with a thickness of 0.20 mm and a width of 820 mm is taken as the substrate, continuous annealing is performed after conventional alkali washing, and tensile strength of the substrate after annealing is 423 MPa.

The leveling step is double-stand leveling, wherein a surface roughness value of a first stand work roll is 1.6 μm, a use distance is 50 km, and a rolling force is 5100 kN. A surface roughness value of a second stand work roll is 0.5 μm, a use distance is 0 km, and a rolling force is 3000 kN. A leveling elongation is 1.1%. A surface roughness value Ra of the substrate after leveling is detected to be 0.6 μm, and a crest number Rpc is 95 $cm^{-1}$. Therefore, a value of 100×Ra+Rpc of the substrate is 155.

The width of the substrate after trimming is 800 mm. An electroplating mode in the electroplating step is a methanesulfonic acid electroplating process, and the substrate passes through an electroplating tank at a speed of 250 m/min during electroplating. A temperature of an electroplating solution is 40° C. A concentration of a free acid in the electroplating solution is 30 mL/L, and an $Sn^{2+}$ concentration is 15 g/L. A total current of an electroplating single face is 7.27 KA, and a current cathode efficiency is 82%.

In the passivating step, a passivation solution is a sodium dichromate solution. A temperature of the passivation solution is 42° C., a pH value is 4.5, and a concentration is 16 g/L. A passivation power density is 150 $C/m^2$. After the passivating step, a $Cr(OH)_3/Cr_2O_3$ passivation film is formed on a surface of the substrate. A mass content ratio of $Cr(OH)_3$ to $Cr_2O_3$ in the passivation film is 1.27.

Embodiment 2

This embodiment provides a method for manufacturing a tin-plated steel plate, including following steps: alkali washing, continuous annealing, leveling, trimming, oiling, and coiling are performed on a substrate sequentially, and then alkali washing, pickling, electroplating, fluxing, soft melting, passivating, oiling, and coiling are performed on the substrate to obtain the tin-plated steel plate. Specifically: a low-carbon cold-rolled hard steel plate with a thickness of 0.23 mm and a width of 878 mm is taken as the substrate, continuous annealing is performed after conventional alkali washing, and tensile strength of the substrate after annealing is 435 MPa.

The leveling step is double-stand leveling, wherein a surface roughness value of a first stand work roll is 1.65 μm, a use distance is 300 km, and a rolling force is 5450 kN. A surface roughness value of a second stand work roll is 0.56 μm, a use distance is 300 km, and a rolling force is 3600 kN. A leveling elongation is 1.25%. A surface roughness value Ra of the substrate after leveling is detected to be 0.59 μm, and a crest number Rpc is 86 $cm^{-1}$. Therefore, a value of 100×Ra+Rpc of the substrate is 145.

The width of the substrate after trimming is 858 mm.

An electroplating mode in the electroplating step is a methanesulfonic acid electroplating process, and the substrate passes through an electroplating tank at a speed of 300 m/min during electroplating. A temperature of an electroplating solution is 43° C. A concentration of a free acid in the electroplating solution is 35 mL/L, and an $Sn^{2+}$ concentration is 17 g/L. A total current of an electroplating single face is 9.47 KA, and a current cathode efficiency is 81%.

In the passivating step, a passivation solution is a sodium dichromate solution. A temperature of the passivation solution is 41° C., a pH value is 4.5, and a concentration is 17 g/L. A passivation power density is 180 $C/m^2$. After the passivating step, a $Cr(OH)_3/Cr_2O_3$ passivation film is formed on a surface of the substrate. A mass content ratio of $Cr(OH)_3$ to $Cr_2O_3$ in the passivation film is 1.46.

Embodiment 3

This embodiment provides a method for manufacturing a tin-plated steel plate, including following steps: alkali washing, continuous annealing, leveling, trimming, oiling, and coiling are performed on a substrate sequentially, and then alkali washing, pickling, electroplating, fluxing, soft melting, passivating, oiling, and coiling are performed on the substrate to obtain the tin-plated steel plate. Specifically: a low-carbon cold-rolled hard steel plate with a thickness of 0.30 mm and a width of 943 mm is taken as the substrate, continuous annealing is performed after conventional alkali washing, and tensile strength of the substrate after annealing is 443 MPa.

The leveling step is double-stand leveling, wherein a surface roughness value of a first stand work roll is 1.6 μm, a use distance is 600 km, and a rolling force is 6000 kN. A surface roughness value of a second stand work roll is 0.53 μm, a use distance is 600 km, and a rolling force is 4000 kN. A leveling elongation is 1.4%. A surface roughness value Ra of the substrate after leveling is detected to be 0.6 μm, and a crest number Rpc is 88 $cm^{-1}$. Therefore, a value of 100×Ra+Rpc of the substrate is 148.

The width of the substrate after trimming is 923 mm. An electroplating mode in the electroplating step is a methanesulfonic acid electroplating process, and the substrate passes through an electroplating tank at a speed of 250 m/min during electroplating. A temperature of an electroplating solution is 46° C. A concentration of a free acid in the electroplating solution is 36 mL/L, and an $Sn^{2+}$ concentration is 18 g/L. A total current of an electroplating single face is 8.59 KA, and a current cathode efficiency is 80%.

In the passivating step, a passivation solution is a sodium dichromate solution. A temperature of the passivation solution is 42° C., a pH value is 4.5, and a concentration is 18 g/L. A passivation power density is 180 $C/m^2$. After the passivating step, a $Cr(OH)_3/Cr_2O_3$ passivation film is formed on a surface of the substrate. A mass content ratio of $Cr(OH)_3$ to $Cr_2O_3$ in the passivation film is 1.5.

Embodiment 4

This embodiment provides a method for manufacturing a tin-plated steel plate, including following steps: alkali washing, continuous annealing, leveling, trimming, oiling, and coiling are performed on a substrate sequentially, and then alkali washing, pickling, electroplating, fluxing, soft melting, passivating, oiling, and coiling are performed on the substrate to obtain the tin-plated steel plate. Specifically: a low-carbon cold-rolled hard steel plate with a thickness of 0.17 mm and a width of 848 mm is taken as the substrate, continuous annealing is performed after conventional alkali washing, and tensile strength of the substrate after annealing is 462 MPa.

The leveling step is double-stand leveling, wherein a surface roughness value of a first stand work roll is 1.6 μm, a use distance is 75 km, and a rolling force is 5150 kN. A surface roughness value of a second stand work roll is 0.6 μm, a use distance is 550 km, and a rolling force is 3900 kN. A leveling elongation is 1.28%. A surface roughness value Ra of the substrate after leveling is detected to be 0.53 μm, and a crest number Rpc is 80 $cm^{-1}$. Therefore, a value of 100×Ra+Rpc of the substrate is 133.

The width of the substrate after trimming is 823 mm.

An electroplating mode in the electroplating step is a methanesulfonic acid electroplating process, and the substrate passes through an electroplating tank at a speed of 280 m/min during electroplating. A temperature of an electroplating solution is 48° C. A concentration of a free acid in the electroplating solution is 38 mL/L, and an $Sn^{2+}$ concentration is 19 g/L. A total current of an electroplating single face is 7.94 KA, and a current cathode efficiency is 85%.

In the passivating step, a passivation solution is a sodium dichromate solution. A temperature of the passivation solution is 43° C., a pH value is 4.5, and a concentration is 17 g/L. A passivation power density is 160 C/m$^2$. After the passivating step, a $Cr(OH)_3/Cr_2O_3$ passivation film is formed on a surface of the substrate. A mass content ratio of $Cr(OH)_3$ to $Cr_2O_3$ in the passivation film is 1.4.

Embodiment 5

This embodiment provides a method for manufacturing a tin-plated steel plate, including following steps: alkali washing, continuous annealing, leveling, trimming, oiling, and coiling are performed on a substrate sequentially, and then alkali washing, pickling, electroplating, fluxing, soft melting, passivating, oiling, and coiling are performed on the substrate to obtain the tin-plated steel plate. Specifically: a low-carbon cold-rolled hard steel plate with a thickness of 0.40 mm and a width of 1055 mm is taken as the substrate, continuous annealing is performed after conventional alkali washing, and tensile strength of the substrate after annealing is 392 MPa.

The leveling step is double-stand leveling, wherein a surface roughness value of a first stand work roll is 1.7 μm, a use distance is 0 km, and a rolling force is 5000 kN. A surface roughness value of a second stand work roll is 0.55 μm, a use distance is 100 km, and a rolling force is 3400 kN. A leveling elongation is 1.15%. A surface roughness value Ra of the substrate after leveling is detected to be 0.56 μm, and a crest number Rpc is 75 cm$^{-1}$. Therefore, a value of 100×Ra+Rpc of the substrate is 131.

The width of the substrate after trimming is 1035 mm.

An electroplating mode in the electroplating step is a methanesulfonic acid electroplating process, and the substrate passes through an electroplating tank at a speed of 300 m/min during electroplating. A temperature of an electroplating solution is 45° C. A concentration of a free acid in the electroplating solution is 36 mL/L, and an $Sn^{2+}$ concentration is 18 g/L. A total current of an electroplating single face is 11.6 KA, and a current cathode efficiency is 80%.

In the passivating step, a passivation solution is a sodium dichromate solution. A temperature of the passivation solution is 42° C., a pH value is 4.5, and a concentration is 18 g/L. A passivation power density is 170 C/m$^2$. After the passivating step, a $Cr(OH)_3/Cr_2O_3$ passivation film is formed on a surface of the substrate. A mass content ratio of $Cr(OH)_3$ to $Cr_2O_3$ in the passivation film is 1.43.

Embodiment 6

This embodiment provides a method for manufacturing a tin-plated steel plate, including following steps: alkali washing, continuous annealing, leveling, trimming, oiling, and coiling are performed on a substrate sequentially, and then alkali washing, pickling, electroplating, fluxing, soft melting, passivating, oiling, and coiling are performed on the substrate to obtain the tin-plated steel plate. Specifically: a low-carbon cold-rolled hard steel plate with a thickness of 0.25 mm and a width of 920 mm is taken as the substrate, continuous annealing is performed after conventional alkali washing, and tensile strength of the substrate after annealing is 476 MPa.

The leveling step is double-stand leveling, wherein a surface roughness value of a first stand work roll is 1.6 μm, a use distance is 100 km, and a rolling force is 5200 kN. A surface roughness value of a second stand work roll is 0.52 μm, a use distance is 75 km, and a rolling force is 3300 kN. A leveling elongation is 1.15%. A surface roughness value Ra of the substrate after leveling is detected to be 0.5 μm, and a crest number Rpc is 65 cm$^1$. Therefore, a value of 100×Ra+Rpc of the substrate is 115.

The width of the substrate after trimming is 900 mm.

An electroplating mode in the electroplating step is a methanesulfonic acid electroplating process, and the substrate passes through an electroplating tank at a speed of 240 m/min during electroplating. A temperature of an electroplating solution is 35° C. A concentration of a free acid in the electroplating solution is 28 mL/L, and an $Sn^{2+}$ concentration is 14 g/L. A total current of an electroplating single face is 7.15 KA, and a current cathode efficiency is 90%.

In the passivating step, a passivation solution is a sodium dichromate solution. A temperature of the passivation solution is 43° C., a pH value is 4.4, and a concentration is 17 g/L. A passivation power density is 120 C/m$^2$. After the passivating step, a $Cr(OH)_3/Cr_2O_3$ passivation film is formed on a surface of the substrate. A mass content ratio of $Cr(OH)_3$ to $Cr_2O_3$ in the passivation film is 1.

Embodiment 7

This embodiment provides a method for manufacturing a tin-plated steel plate, including following steps: alkali washing, continuous annealing, leveling, trimming, oiling, and coiling are performed on a substrate sequentially, and then alkali washing, pickling, electroplating, fluxing, soft melting, passivating, oiling, and coiling are performed on the substrate to obtain the tin-plated steel plate. Specifically: a low-carbon cold-rolled hard steel plate with a thickness of 0.35 mm and a width of 908 mm is taken as the substrate, continuous annealing is performed after conventional alkali washing, and tensile strength of the substrate after annealing is 385 MPa.

The leveling step is double-stand leveling, wherein a surface roughness value of a first stand work roll is 1.62 μm, a use distance is 550 km, and a rolling force is 5850 kN. A surface roughness value of a second stand work roll is 0.54 μm, a use distance is 50 km, and a rolling force is 3200 kN. A leveling elongation is 1.8%. A surface roughness value Ra of the substrate after leveling is detected to be 0.55 μm, and a crest number Rpc is 71 cm$^{-1}$. Therefore, a value of 100×Ra+Rpc of the substrate is 126.

The width of the substrate after trimming is 888 mm.

An electroplating mode in the electroplating step is a methanesulfonic acid electroplating process, and the substrate passes through an electroplating tank at a speed of 220 m/min during electroplating. A temperature of an electroplating solution is 55° C. A concentration of a free acid in the electroplating solution is 33 mL/L, and an $Sn^{2+}$ concentration is 16 g/L. A total current of an electroplating single face is 7.9 KA, and a current cathode efficiency is 83%.

In the passivating step, a passivation solution is a sodium dichromate solution. A temperature of the passivation solution is 41° C., a pH value is 4.4, and a concentration is 16 g/L. A passivation power density is 135 C/m$^2$. After the passivating step, a $Cr(OH)_3/Cr_2O_3$ passivation film is formed on a surface of the substrate. A mass content ratio of $Cr(OH)_3$ to $Cr_2O_3$ in the passivation film is 1.1.

Embodiment 8

This embodiment provides a method for manufacturing a tin-plated steel plate, including following steps: alkali washing, continuous annealing, leveling, trimming, oiling, and coiling are performed on a substrate sequentially, and then alkali washing, pickling, electroplating, fluxing, soft melting, passivating, oiling, and coiling are performed on the substrate to obtain the tin-plated steel plate. Specifically:

a low-carbon cold-rolled hard steel plate with a thickness of 0.21 mm and a width of 1000 mm is taken as the substrate, continuous annealing is performed after conventional alkali washing, and tensile strength of the substrate after annealing is 485 MPa.

The leveling step is double-stand leveling, wherein a surface roughness value of a first stand work roll is 1.68 μm, a use distance is 500 km, and a rolling force is 5700 kN. A surface roughness value of a second stand work roll is 0.54 μm, a use distance is 500 km, and a rolling force is 3800 kN. A leveling elongation is 1%. A surface roughness value Ra of the substrate after leveling is detected to be 0.56 μm, and a crest number Rpc is 74 $cm^{-1}$. Therefore, a value of 100×Ra+Rpc of the substrate is 130.

The width of the substrate after trimming is 980 mm.

An electroplating mode in the electroplating step is a methanesulfonic acid electroplating process, and the substrate passes through an electroplating tank at a speed of 260 m/min during electroplating. A temperature of an electroplating solution is 50° C. A concentration of a free acid in the electroplating solution is 29 mL/L, and an $Sn^{2+}$ concentration is 14 g/L. A total current of an electroplating single face is 8.81 KA, and a current cathode efficiency is 88%.

In the passivating step, a passivation solution is a sodium dichromate solution. A temperature of the passivation solution is 42° C., a pH value is 4.5, and a concentration is 18 g/L. A passivation power density is 165 $C/m^2$. After the passivating step, a $Cr(OH)_3/Cr_2O_3$ passivation film is formed on a surface of the substrate. A mass content ratio of $Cr(OH)_3$ to $Cr_2O_3$ in the passivation film is 1.36.

Embodiment 9

This embodiment provides a method for manufacturing a tin-plated steel plate, including following steps: alkali washing, continuous annealing, leveling, trimming, oiling, and coiling are performed on a substrate sequentially, and then alkali washing, pickling, electroplating, fluxing, soft melting, passivating, oiling, and coiling are performed on the substrate to obtain the tin-plated steel plate. Specifically:

a low-carbon cold-rolled hard steel plate with a thickness of 0.25 mm and a width of 820 mm is taken as the substrate, continuous annealing is performed after conventional alkali washing, and tensile strength of the substrate after annealing is 410 MPa.

The leveling step is double-stand leveling, wherein a surface roughness value of a first stand work roll is 1.63 μm, a use distance is 25 km, and a rolling force is 5050 kN. A surface roughness value of a second stand work roll is 0.51 μm, a use distance is 25 km, and a rolling force is 3100 kN. A leveling elongation is 1.6%. A surface roughness value Ra of the substrate after leveling is detected to be 0.54 μm, and a crest number Rpc is 68 $cm^{-1}$. Therefore, a value of 100×Ra+Rpc of the substrate is 122.

The width of the substrate after trimming is 800 mm.

An electroplating mode in the electroplating step is a methanesulfonic acid electroplating process, and the substrate passes through an electroplating tank at a speed of 200 m/min during electroplating. A temperature of an electroplating solution is 38° C. A concentration of a free acid in the electroplating solution is 32 mL/L, and an $Sn^{2+}$ concentration is 15 g/L. A total current of an electroplating single face is 5.3 KA, and a current cathode efficiency is 90%.

In the passivating step, a passivation solution is a sodium dichromate solution. A temperature of the passivation solution is 42° C., a pH value is 4.4, and a concentration is 17 g/L. A passivation power density is 140 $C/m^2$. After the passivating step, a $Cr(OH)_3/Cr_2O_3$ passivation film is formed on a surface of the substrate. A mass content ratio of $Cr(OH)_3$ to $Cr_2O_3$ in the passivation film is 1.25.

Comparative Example 1

This comparative example provides a method for manufacturing a tin-plated steel plate, which differs from Embodiment 1 only in that: after a leveling step, a surface roughness value Ra of a substrate is 0.52 μm, a crest number Rpc is 70 $cm^{-1}$, a value of 100×Ra+Rpc is 122, and a passivation power density in a passivating step is 110 $C/m^2$.

Comparative Example 2

This comparative example provides a method for manufacturing a tin-plated steel plate, which differs from Embodiment 1 only in that: after a leveling step, a surface roughness value Ra of a substrate is 0.6 μm, a crest number Rpc is 88 $cm^{-1}$, a value of 100×Ra+Rpc is 148, and a passivation power density in a passivating step is 185 $C/m^2$.

Comparative Example 3

This comparative example provides a method for manufacturing a tin-plated steel plate, which differs from Embodiment 1 only in that: in a passivating step, a pH value of a passivation solution is 4.

Comparative Example 4

This comparative example provides a method for manufacturing a tin-plated steel plate, which differs from Embodiment 1 only in that: in a passivating step, a concentration of a passivation solution is 20 g/L.

Comparative Example 5

This comparative example provides a method for manufacturing a tin-plated steel plate, which differs from Embodiment 1 only in that: in a passivating step, a temperature of a passivation solution is 40° C.

Comparative Example 6

This comparative example provides a method for manufacturing a tin-plated steel plate, which differs from Embodiment 1 only in that: in a leveling step, a surface roughness value Ra of a first stand work roll is 1.5 m.

Comparative Example 7

This comparative example provides a method for manufacturing a tin-plated steel plate, which differs from Embodiment 1 only in that: in a leveling step, a surface roughness value Ra of a second stand work roll is 0.3 m.

Comparative Example 8

This comparative example provides a method for manufacturing a tin-plated steel plate, which differs from Embodiment 1 only in that: in a leveling step, a rolling force of a first stand work roll is 6500 kN, and a rolling force of a second stand work roll is 2500 kN.

Comparative Example 9

This comparative example provides a method for manufacturing a tin-plated steel plate, which differs from Embodiment 1 only in that: in a leveling step, use distances of a first stand work roll and a second stand work roll are both 650 km.

Comparative Example 10

This comparative example provides a method for manufacturing a tin-plated steel plate, which differs from Embodiment 1 only in that: in an electroplating step, an $Sn^{2+}$ concentration of an electroplating solution is 25 g/L.

Test Example 1

An edge of the tin-plated steel plate manufactured in each embodiment and each comparative example is taken and cut into a sample piece of 120 mm×120 mm. A surface of the steel plate is uniformly coated with solvent-based gold paint by using a manual or mechanical device to operate a scraper bar. A thickness of the paint film is controlled according to a model of the scraper bar. The thickness of the paint film is usually about 6 g/m$^2$ for one time of coating. Subsequently, the coated steel plate is placed into an oven that has been heated to 200° C., baked for 15 minutes, and then taken out and air-cooled to a room temperature. The above coating and baking process is repeated once, so that the thickness of the paint film is about 12 g/m$^2$.

The above coated sample plate is cut into samples of 120 mm×60 mm in size, the samples are placed on a loading table of a QFD type paint film electric adhesion tester for a circle scratching test, an appropriate weight is chosen to be loaded so that a needle scratches each paint film, a length of circle scratching is in a range from 60 mm to 80 mm, and a diameter of each circle is 10 mm. The surface of each sample plate after circle scratching is brushed clean with a brush, a whole surface is covered with 3M610 tape, the tape is flattened with a finger pulp, so that the tape and a circle-scratched part are tightly attached, the tape is torn off from the coating film in a diagonal upward direction quickly, and the condition of the paint film on the circle-scratched part of the surface is observed.

A damage degree of the paint film in each part is checked, adhesion is evaluated according to Table 2, and evaluation results are shown in Table 4. According to the actual feedback from customers, usually level 1 is considered to have good adhesion, level 2 is considered to have average adhesion but may be used normally, and levels 3-4 have poor adhesion and cannot be used normally.

TABLE 2

Adhesion evaluation criteria

| Adhesion/ level | Area of torn off coating film/% |
|---|---|
| 1 | 0 |
| 2 | ≤10 |
| 3 | ≤25 |
| 4 | ≤50 |

Test Example 2

An edge of the tin-plated steel plate manufactured in each embodiment and each comparative example is taken and cut into a sample piece of 50 mm×50 mm, a corrosion resistance thereof is tested, and a specific test method is:

50 g of citric acid, 0.14 g of sodium nitrate, and 0.5 g of ascorbic acid are taken, dissolved with water, and mixed and diluted to 1000 mL as a test solution; and a wire is welded to a back of the sample piece, and the back and corners of the sample piece are coated with melted beeswax. The sample piece is immersed into the test solution prepared above, a stainless steel bar with a diameter of 4 mm and a length of 10 mm is used as a cathode, the sample piece is used as an anode, and a 15 V direct current power source is connected to cause anodic corrosion. After 1 h, the sample piece is taken out, and washed with clean water, and a surface is blown with a hairdryer to a dry state, the size and number of corrosion spots are observed, a corrosion resistance is evaluated according to Table 3, and evaluation results are shown in Table 4.

TABLE 3

Corrosion resistance evaluation criteria

| Corrosion resistance/ level | Degree of corrosion |
|---|---|
| 0 | Free of corrosion spots |
| 1 | 10 or less corrosion spots with a length ≤ 1 mm; 5 or less corrosion spots with a length ranging from 1 mm to 2 mm |
| 2 | Less than 30 corrosion spots with a length ≤ 1 mm; less than 10 corrosion spots with a length ranging from 1 mm to 2 mm |
| 3 | More than 30 corrosion spots with a length ≤ 1 mm; more than 10 corrosion spots with a length ranging from 1 mm to 2 mm; with corrosion spots with a length > 2 mm |

Test Example 3

The tin-plated steel plate manufactured in each embodiment and each comparative example is taken and cut into sample pieces of 4 mm×4 mm. Detection and analysis are performed by using XPS. The composition of the passivation films at different depths is tested by argon ion sputtering. Crest-split results of contaminated carbon data are taken as criteria, and necessary charge corrections are performed on other elements. Crest-split fitting is performed on the calibrated data by using data fitting software. A mass content ratio of $Cr(OH)_3$ to $Cr_2O_3$ is determined according to a crest area ratio. The mass content ratio of $Cr(OH)_3$ to $Cr_2O_3$=a mass percentage of $Cr(OH)_3$ in the passivation film/a mass percentage of $Cr_2O_3$ in the passivation film.

TABLE 4

Test results of test examples

| Test | Adhesion/ level | Corrosion resistance/level | Mass content ratio of $Cr(OH)_3/Cr_2O_3$ |
|---|---|---|---|
| Embodiment 1 | 1 | 0 | 1.27 |
| Embodiment 2 | 1 | 0 | 1.46 |
| Embodiment 3 | 1 | 0 | 1.5 |
| Embodiment 4 | 1 | 0 | 1.4 |
| Embodiment 5 | 1 | 0 | 1.43 |
| Embodiment 6 | 1 | 0 | 1 |
| Embodiment 7 | 1 | 0 | 1.1 |
| Embodiment 8 | 1 | 0 | 1.36 |
| Embodiment 9 | 1 | 0 | 1.25 |
| Comparative example 1 | 1 | 3 | 0.82 |

TABLE 4-continued

| Test results of test examples | | | |
|---|---|---|---|
| Test | Adhesion/ level | Corrosion resistance/level | Mass content ratio of $Cr(OH)_3/Cr_2O_3$ |
| Comparative example 2 | 3 | 0 | 1.76 |
| Comparative example 3 | 3 | 0 | 1.68 |
| Comparative example 4 | 3 | 0 | 1.82 |
| Comparative example 5 | 3 | 3 | 0.93 |
| Comparative example 6 | 3 | 0 | 1.26 |
| Comparative example7 | 4 | 0 | 1.29 |
| Comparative example 8 | 3 | 0 | 1.26 |
| Comparative example 9 | 3 | 0 | 1.27 |
| Comparative example 10 | 3 | 0 | 1.32 |

Obviously, the above embodiments are only examples for clear illustration and are not a limitation of the implementations. For those of ordinary skill in the art, other variations or changes in different forms may further be made on the basis of the above illustration. It is not necessary or possible to exhaust all implementations herein. Obvious variations or changes derived therefrom remain within the scope of protection of the present disclosure.

The invention claimed is:

1. A method for manufacturing a tin-plated steel plate, wherein in a step of leveling a substrate, double-stand leveling is adopted, and use distances of a first stand work roll and a second stand work roll are ≤600 km; a surface roughness value Ra of the first stand work roll is in a range from 1.6 μm to 1.7 μm, and a rolling force is in a range from 5000 kN to 6000 kN; a surface roughness value Ra of the second stand work roll is in a range from 0.5 m to 0.6 μm, and a rolling force is in a range from 3000 kN to 4000 kN;

in a step of electroplating the substrate, an $Sn^{2+}$ concentration of an electroplating solution is in a range from 14 g/L to 19 g/L;

in a step of passivating the substrate, a temperature of a passivation solution is in a range from 41° C. to 43° C., a pH value is in a range from 4.4 to 4.6, a concentration is in a range from 16 g/L to 18 g/L, and a passivation power density is in a range from 120 $C/m^2$ to 180 $C/m^2$;

when a surface roughness value Ra and a crest number Rpc of the substrate meet 115≤100×Ra+Rpc<130, 120 $C/m^2$≤passivation power density <150 $C/m^2$; and when the surface roughness value Ra and the crest number Rpc of the substrate meet 130≤100×Ra+Rpc≤155, 150 $C/m^2$≤passivation power density ≤180 $C/m^2$;

the unit of the surface roughness value Ra is m, and the unit of the crest number Rpc of the substrate is $cm^{-1}$.

2. The method for manufacturing the tin-plated steel plate according to claim 1, wherein a leveling elongation in the leveling step is in a range from 1% to 1.8%.

3. The method for manufacturing the tin-plated steel plate according to claim 1, wherein in the leveling step:

when the use distance of the first stand work roll is ≤50 km, 5000 kN≤the rolling force of the first stand work roll≤5100 kN;

when 50 km<the use distance of the first stand work roll≤100 km, 5100 kN≤the rolling force of the first stand work roll≤5200 kN;

when 100 km<the use distance of the first stand work roll≤500 km, 5200 kN≤the rolling force of the first stand work roll≤5700 kN; and when 500 km<the use distance of the first stand work roll≤600 km, 5700 kN≤the rolling force of the first stand work roll≤6000 kN.

4. The method for manufacturing the tin-plated steel plate according to claim 1, wherein in the leveling step:

when the use distance of the second stand work roll is ≤50 km, 3000 kN≤the rolling force of the second stand work roll≤3200 kN;

when 50 km<the use distance of the second stand work roll≤100 km, 3200 kN≤the rolling force of the second stand work roll≤3400 kN;

when 100 km<the use distance of the second stand work roll≤500 km, 3400 kN≤the rolling force of the second stand work roll≤3800 kN; and when 500 km<the use distance of the second stand work roll≤600 km, 3800 kN≤the rolling force of the second stand work roll≤4000 kN.

5. The method for manufacturing the tin-plated steel plate according to claim 1, wherein after the leveling step, the substrate has the surface roughness value Ra ranging from 0.5 μm to 0.6 μm and the crest number Rpc ranging from 65 $cm^{-1}$ to 95 $cm^{-1}$.

6. The method for manufacturing the tin-plated steel plate according to claim 1, wherein an electroplating mode in the electroplating step is a methanesulfonic acid electroplating process, and the substrate passes through an electroplating tank at a speed ranging from 200 m/min to 300 m/min during electroplating.

7. The method for manufacturing the tin-plated steel plate according to claim 1, wherein in the electroplating step, a temperature of the electroplating solution is in a range from 35° C. to 55° C.

8. The method for manufacturing the tin-plated steel plate according to claim 1, wherein in the electroplating step, a concentration of a free acid in the electroplating solution is in a range from 28 mL/L to 38 mL/L;

and/or, a total current of an electroplating single face is in a range from 5.3 KA to 11.6 KA, and a current cathode efficiency is in a range from 80% to 90%.

9. The method for manufacturing the tin-plated steel plate according to claim 1, wherein after the passivating step, a $Cr(OH)_3/Cr_2O_3$ passivation film is formed on a surface of the substrate; and a mass content ratio of $Cr(OH)_3$ to $Cr_2O_3$ in the passivation film is in a range from 1 to 1.5.

10. The method for manufacturing the tin-plated steel plate according to claim 1, wherein a continuous annealing step is further comprised before leveling, and tensile strength of the substrate after the continuous annealing step is in a range from 385 MPa to 485 MPa.

11. The method for manufacturing the tin-plated steel plate according to claim 1, wherein the passivation solution is a sodium dichromate solution.

* * * * *